US005132704A

United States Patent [19]

Nakagawa

[11] Patent Number: 5,132,704

[45] Date of Patent: Jul. 21, 1992

[54] THERMAL RECORDING APPARATUS

[75] Inventor: Tatsuhide Nakagawa, Tokyo, Japan

[73] Assignee: Mutoh Industries Ltd., Tokyo, Japan

[21] Appl. No.: 647,368

[22] Filed: Jan. 29, 1991

[30] Foreign Application Priority Data

Jan. 30, 1990 [JP] Japan ..... 2-20023

[51] Int. Cl.[5] ..... B41J 2/32

[52] U.S. Cl. ..... 346/76 PH; 400/120

[58] Field of Search ..... 346/76 PH; 400/120 HE, 400/58, 706, 708, 120

[56] References Cited

U.S. PATENT DOCUMENTS

| | | | |
|---|---|---|---|
| 4,143,977 | 3/1979 | Kurihara et al. | 400/58 |
| 4,660,052 | 4/1987 | Kaiya et al. | 346/76 PH |
| 4,738,553 | 4/1988 | Uemura et al. | 346/76 PH |
| 4,855,755 | 8/1989 | Aizawa | 346/76 PH |
| 4,977,410 | 12/1990 | Onuki | 346/76 PH |

FOREIGN PATENT DOCUMENTS

| | | | |
|---|---|---|---|
| 0176789 | 9/1985 | Japan | 400/708 |
| 0149470 | 7/1987 | Japan | 400/120 HE |

*Primary Examiner*—Benjamin R. Fuller
*Assistant Examiner*—Huan Tran
*Attorney, Agent, or Firm*—Oblon, Spivak, McClelland, Maier & Neustadt

[57] ABSTRACT

In a thermal recording apparatus according to the present invention, when recording paper having a maximum width is set, no solenoids operate. A thermal head supported by a support energized by a spring is thus pressed against a platen roller. An image is thermally formed by a resistance heating element array of the thermal head on the recording paper supplied between the platen roller and the thermal head. When small-sized recording paper is supplied, sensors detect a leading edge of the paper. The controller turns on the solenoid of an assembly in which a thermal head which does not participate in the recording is provided. Thus, a drive shaft of the solenoid retracts to space the support away from the platen roller. The thermal head and platen roller of the assembly are spaced from each other, and a platen roller which the recording paper does not pass is prevented from contacting on the thermal head. The waste of power required for driving the platen roller is thus avoided.

5 Claims, 4 Drawing Sheets

THERMAL RECORDING APPARATUS

BACKGROUND OF THE INVENTION

The present invention relates to a thermal recording apparatus such as a thermal paper recording apparatus and a thermal transfer recording apparatus and, more particularly, to a thermal recording apparatus suitable for recording an image on large-sized recording paper.

As a conventional automatic drawing apparatus for drawing on large-sized paper of A0, A1 or the like, a pen plotter and a thermal recording apparatus with an in-line thermal head having an array structure are used. Because of a high-speed operation, low noise and easy maintenance, the thermal recording apparatus is frequently used. Since a long thermal head adaptable for A0- and A1-sized paper is low in manufacturing yield, its manufacturing cost is increased and its maintenance is difficult. Such a long thermal head cannot be easily put to practical use. For this reason, in the conventional thermal recording apparatus, a plurality of popular thermal heads such as heads for A3-sized paper are consecutively arranged in a line direction to record an image on paper having a large size such as A0 and A1.

In the conventional thermal recording apparatus, when an image is recorded on small-sized recording paper of A3 or the like, at least one of the plural thermal heads, which overhangs from the recording paper, is not supplied with a recording signal and thus it is not electrically driven. Nevertheless, the thermal head which is not electrically driven, is pressed against a platen roller, together with the other electrically-driven thermal heads, and it is mechanically driven.

Since the platen roller not only presses the recording paper against the thermal head but also feeds the paper by its rotation, its surface has a high frictional resistance. If the platen roller is pressed against the thermal heads without interposing any recording paper therebetween, the platen roller frictionally contacts the thermal head by its rotation and a resistance force is given from the thermal head to the rotation of the platen roller. As a result, a driving apparatus for rotating the platen roller has a drawback in which power required for rotating the platen roller is wasted.

SUMMARY OF THE INVENTION

It is accordingly an object of the present invention to provide a thermal recording apparatus capable of properly driving a platen roller in accordance with the size of the recording paper and preventing a waste of power necessary for rotating the platen roller.

The thermal recording apparatus according to the present invention comprises:

a plurality of thermal heads each having a resistance heating element and arranged in a direction substantially perpendicular to the feeding direction of recording paper;

a platen roller provided for each of said thermal heads;

drive means for rotating said platen roller;

press means for pressing said thermal head and/or said platen roller against the another;

release means for releasing the pressing of said thermal head and platen roller by said press means; and selecting means for selecting the pairs of thermal heads and platen rollers which should be released the pressing by the release means based on a width of said recording paper.

In the thermal recording apparatus of the present invention, a plurality of thermal heads are arranged in a direction substantially perpendicular to the feed direction of the recording paper, and a platen roller is provided for each of the thermal heads. Each thermal head records an image on part of the recording paper supplied between the platen roller and the thermal head. In other words, a large image is divided in a direction substantially perpendicular to the feed direction of large-sized recording paper and each of the thermal heads records an individual image obtained by dividing the large image.

When an image is formed on small-sized recording paper, a control means causes a release means to disengage the contact between a thermal head overhanging from the recording paper and the platen roller.

In the thermal head which is neither supplied with a signal nor electrically driven, the contact between the thermal head and platen roller is released by the release means, so that they do not directly in contact each other when there is no recording paper. Therefore, the platen roller does not frictionally contact the thermal head and no resistance force is applied to the rotation of the platen roller. It is thus possible to avoid wasting power required for rotating the platen roller.

DESCRIPTION OF THE PREFERRED EMBODIMENT

Figure 1:
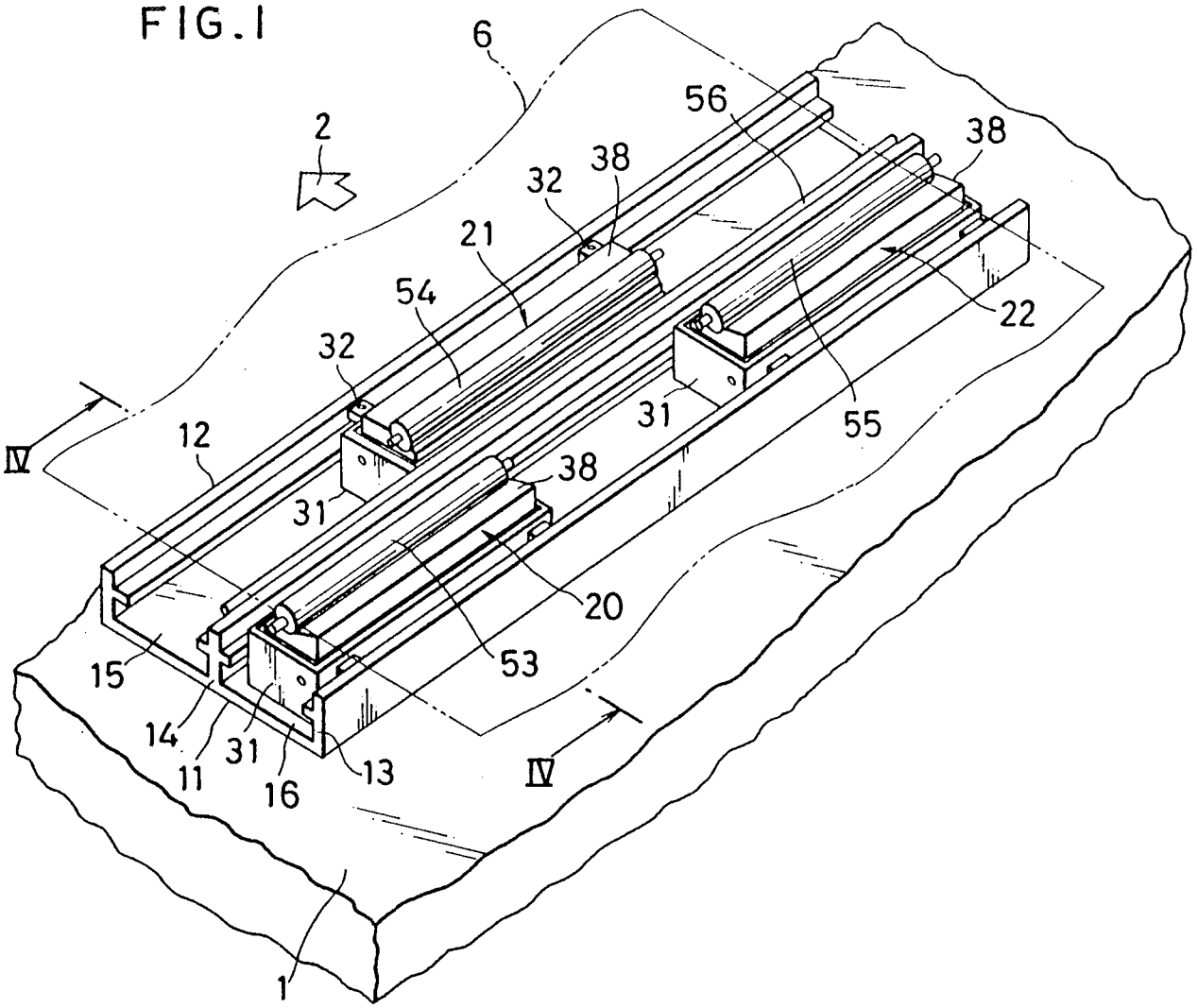
FIG. 1 is a perspective view of a thermal head of a thermal recording apparatus according to an embodiment of the present invention.

As illustrated in FIG. 1, three thermal head assemblies 20 to 22 are arranged on base 1 of a thermal recording apparatus in a direction substantially perpendicular to the feed direction 2 (indicated by arrow) of recording paper 6. Assemblies 20 to 22 are provided with their corresponding platen rollers 53, 54 and 55. Each of the assemblies includes thermal head 38. In order to sequentially arrange the recording areas of thermal heads 38 in the width direction of recording paper 6, assemblies 20 and 22 are arranged at positions corresponding to both side portions of recording paper 6, and assembly 21 is arranged at a position corresponding to the center of recording paper 6 and slightly displaced downstream of the feed direction 2 from assemblies 20 and 22. Each thermal head 38 has a recording area for A3-sized paper and an image can thus be recorded on recording paper 6 of A0 by the combination of three thermal heads 38.

Guide 11 is fixed onto base 1 and has three walls 12 to 14 which extend in a direction substantially perpendicular to feed direction 2. Walls 12 to 14 form two grooves 15 and 16. Assemblies 20 and 22 are fitted into groove 16 formed upstream of feed direction 2, and assembly 21 is fitted into groove 15 downstream thereof.

Drive shaft 56 of the platen rollers is disposed between assembly 21 and assemblies 20 and 22 in view of feed direction 2, in other words, the drive shaft is disposed above wall 14.

Figure 2:
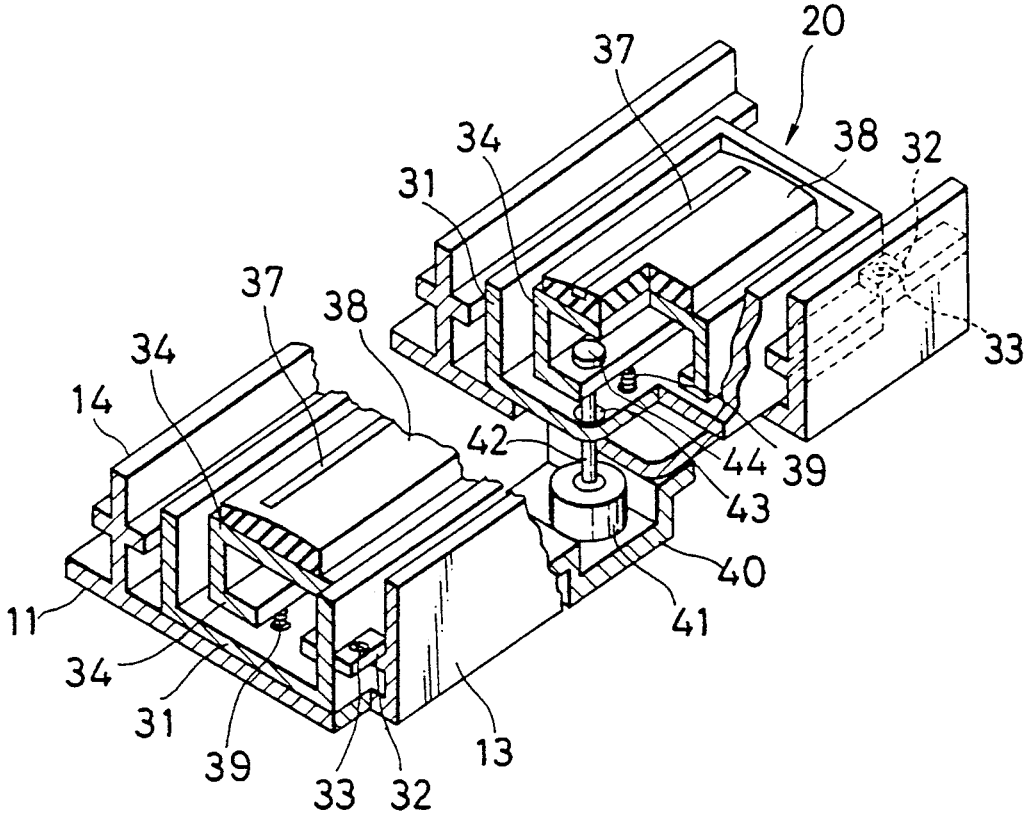
FIG. 2 is a partially cutout perspective view of a mounting device of the thermal head shown in FIG. 1.
Figure 3:
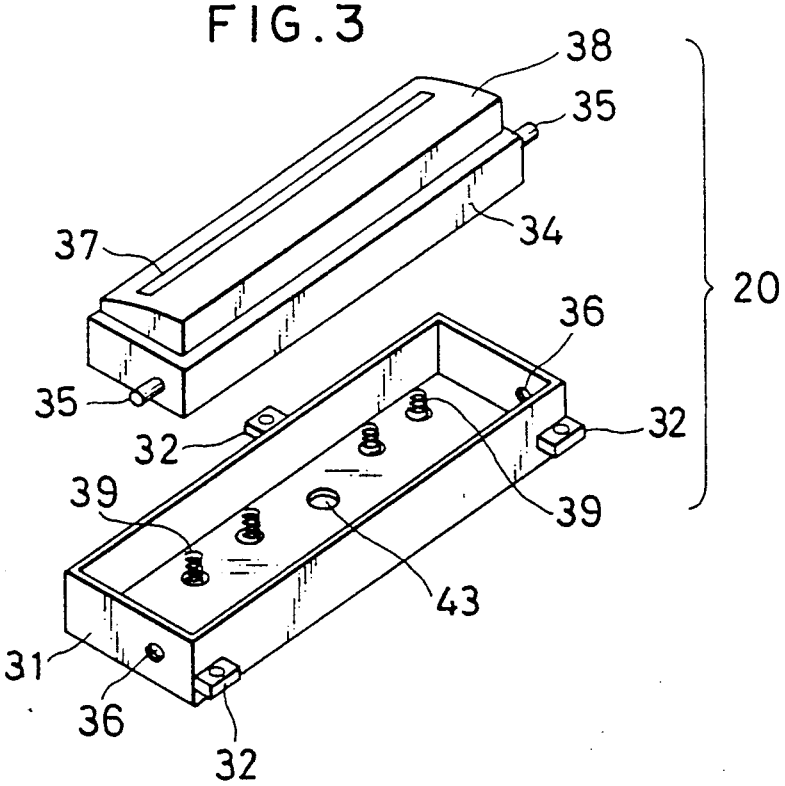
FIG. 3 is an exposed respective view of the mounting device shown in FIG. 2.

To explain the structures of assemblies 20 to 22, assembly 20 is picked out and its structure will be described with reference to attached FIGS. 2 and 3. Claw 32 with a hole is projected from the side of case 31 with an open top. Screw 33 is inserted through the hole of claw 32 and fastened onto wall 13. Case 31 is thus fixed in a predetermined position of guide 11.

Holes 36 are formed on the end surfaces of case 31 at positions located toward the side surface. Rotation shaft 35 is projected from both ends of long head support 34 and inserted through holes 36. Head support 34 is thus housed in case 31 so as to be slightly rotated by rotation shaft 35. Springs 39 are arranged on the bottom surface of case 31 and biases support 34 upwardly. Hole 43 is formed in the center of the bottom of case 31.

Thermal head 38 is fixed onto head support 34, and resistance heating element array 37 of the thermal head is formed in parallel with rotation shaft 35 in its longitudinal direction. Resistance heating element array 37 has a length capable of recording an image on A3-sized recording paper. Solenoid supporting plate 40 is fixed to base 11 in a position conforming to the center of case 31 of assembly 20 and it is protruded from the undersurface of base 11. Solenoid 41 is fixed to solenoid supporting plate 40 with its drive shaft 42 extending upwardly. Drive shaft 42 passes through hole 43 of case 31 and penetrates the bottom of hollow support 34. Drive shaft 42 is provided with disk-like engaging member 44 at its distal end, and engaging member 44 is engaged with the bottom of support 34. If solenoid 41 is turned on and drive shaft 42 is retracted, engaging member 44 rotates support 34 downwardly against the compression force of spring 39.

Assemblies 21 and 22 have the same structure as that of assembly 20. Resistance heating element arrays 37 of thermal heads 38 of assemblies 20 to 22 are arranged at predetermined positions of guide 11 with high precision so that the recording areas of the thermal heads are sequentially arranged in the width direction of recording paper 6.

Figure 5:
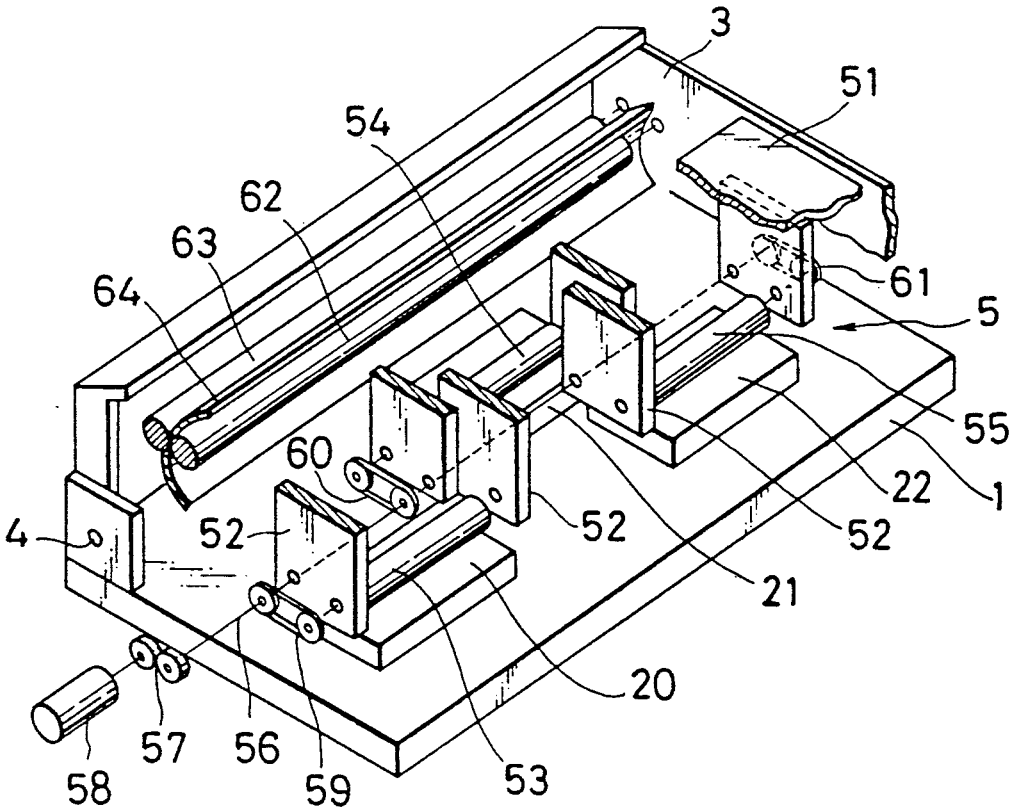
FIG. 5 is a partially cutout perspective view of a feed mechanism of recording paper of the thermal recording apparatus shown in FIG. 1.
Figure 6:
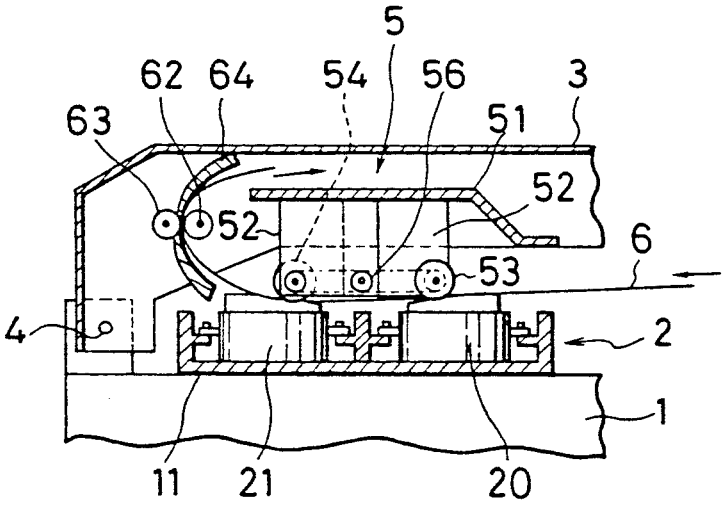
FIG. 6 is a partially cutout cross-sectional view of the feed mechanism shown in FIG. 5.

The mechanism of feeding recording paper 6 will be described with reference to accompanying FIGS. 5 and 6. Cover 3 is formed above base 1 so as to cover thermal heads 38 and to be rotated by means of support shaft 4 disposed downstream of recording paper feed direction 2. Support plate 51 is fixed between both sides of cover 3. Above assemblies 20 to 22, support plate 51 extends in parallel with base 1. Mounting plates 52 for supporting the shafts of platen rollers 53 to 55 hang from support plate 51 at positions conforming with both ends of the thermal heads of assemblies 20 to 22. The shafts of platen rollers 53 to 55 are rotatably supported by mounting plates 52 at both ends. When cover 3 is closed, platen rollers 53 to 55 are arranged to conform with resistance heating element arrays 37 of thermal heads 38 of assemblies 20 to 22. Drive shaft 56 is rotatably mounted through mounting plates 52 halfway between platen rollers 53 and 55 on one hand and platen roller 54 on the other hand. Drive shaft 56 is coupled to the central shafts of platen rollers 53 to 55 by means of belts 59 to 61, respectively. One end of drive shaft 56 extends outside from cover 3 and is coupled with a rotation shaft of motor 58, which is provided outside the cover, by means of gear 57. When motor 58 is driven, the driving force is transmitted to platen rollers 53 to 55 via gear 57, drive shaft 56, and belts 59 to 61. The platen rollers 53 to 55 are thus rotated.

Recording paper feed rollers 62 and 63 and recording paper guide 64 are arranged downstream of platen roller 54 in recording paper feed direction 2. The shafts of feed rollers 62 and 63 are rotatably supported by the side plate of cover 3, and guide 64 is curved in a semicircular form and fixed onto the side plate of cover 3.

Figure 7:
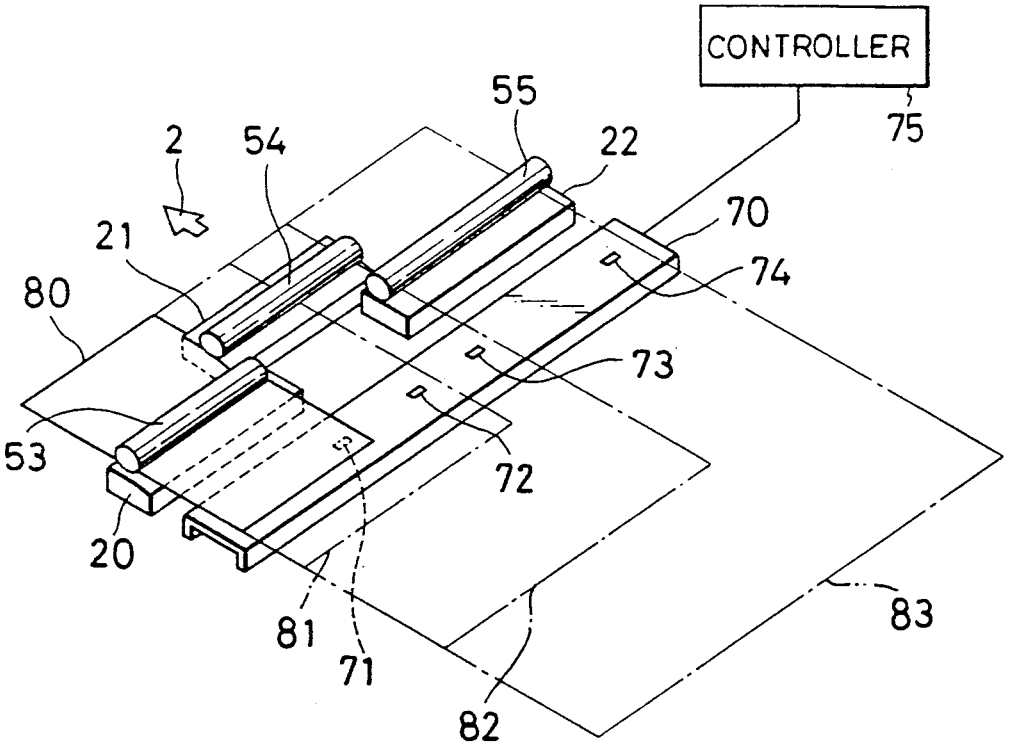
FIG. 7 is a schematic view showing the relationship between the recording paper and the thermal head.

As simply shown in FIG. 7, plate-like recording paper guide 70 is fixed onto base 1 upstream of platen rollers 53 and 55 in feed direction 2. Sensors 71 to 74 for detecting a size of recording paper are buried in guide 70. Sensors 71 to 74 detect the side edges of A0-sized recording paper 83, A1-sized recording paper 82, A2-sized recording paper 81, and A3-sized recording paper 80, respectively. Output signals of sensors 71 to 74 are supplied to controller 75. Controller 75 controls the driving of solenoids 41 of assemblies 20 to 22.

An operation of the thermal recording apparatus having the above structure will be described.

Once cover 3 is opened, platen rollers 53 to 55, feed rollers 62 and 63, and guide 64 are spaced away from assemblies 20 to 22 of thermal heads 38. The leading edge of recording paper 6 is caused to pass near assemblies 20 to 22, then returned along the inside surface of guide 64, and guided between the inner surface of cover 3 and support plate 51. Cover 3 is then closed. Recording paper 6 is thus set in the thermal recording apparatus, as shown in FIG. 6.

Figure 4A:
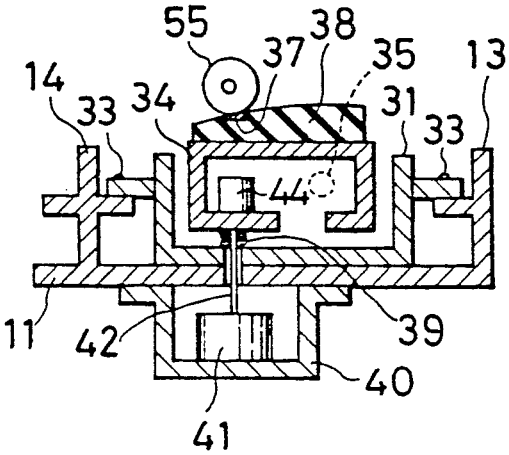
FIG. 4 is a cross-sectional view of a release device of the thermal recording apparatus, taken along the line IV—IV of FIG. 1.
Figure 4B:
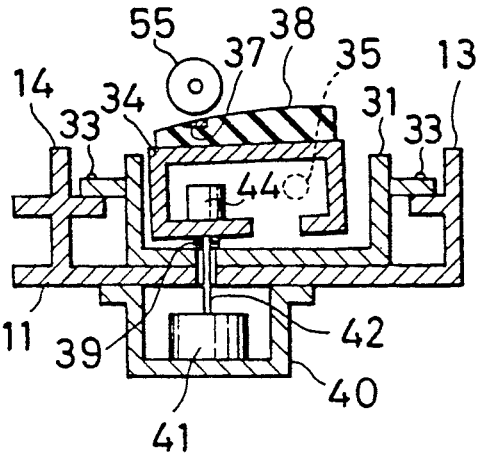

As illustrated in FIG. 7, when A0-sized recording paper 83 is set, all sensors 71 to 74 detect it. Controller 75 thus turns off solenoids 41 of all assemblies 20 to 22 and, as shown in FIG. 4(*a*), three thermal heads 38 are pressed against platen rollers 53 to 55 by springs 39 with recording paper 83 interposed therebetween. The driving force of drive motor 58 is transmitted to platen rollers 53 to 55 via gear 57, drive shaft 56, and belts 59 to 61, and recording paper 83 is supplied in feed direction 2. Thermal recording can thus be performed on A0-sized paper by three thermal heads 38 in synchronization with the rotation of platen rollers 53 to 55.

When A1-sized recording paper 82 is set, sensors 71 to 73 detect it, but not sensor 74. Solenoid 41 of assembly 22 is turned on and, as shown in FIG. 4(*b*), drive shaft 42 of solenoid 41 is retracted and support 34 of assembly 22 rotates downwardly by means of rotation shaft 35. Thermal head 38 is then spaced away from platen roller 55. Since rotating platen roller 55 does not frictionally contact thermal head 38, a mechanical load applied to platen roller 55 is reduced and thus power of drive motor 58 can be decreased. In this case, thermal recording can be performed on A1-sized paper using two thermal heads 38 adapted for A3-sized paper.

When A2-sized recording paper is supplied, the same recording as that of A1-sized paper is performed using the thermal heads of assemblies 20 and 21. When A3-sized recording paper 80 is supplied, controller 75 turns on solenoids 41 of assemblies 21 and 22. Thermal heads 38 of assemblies 21 and 22 are spaced apart from platen rollers 54 and 55, recording is performed only by assembly 20 and platen roller 53. Platen rollers 54 and 55 are not brought into contact with thermal heads 38. Therefore, when thermal recording is performed on A3-sized paper, the resistance force accompanying the rotation of platen rollers 54 and 55 is virtually zero, the load of drive motor 58 is minimized, and the power of the drive motor is greatly decreased.

In the above-described embodiment, a size of recording paper is detected by sensors 71 to 74. However, an operator can input data of the size of paper. The present invention can be applied to not only thermal recording but also heat-transfer recording using a thermal fusion ink ribbon.

What is claimed is:

1. A thermal printer for thermally recording an image on recording paper, comprising:

a plurality of platen rollers having parallel axes;

a plurality of thermal heads respectively provided for said plurality of platen rollers, each of said thermal heads having a resistance heating element array;

drive means for rotating said platen rollers;

press means for pressing said thermal heads and said platen rollers toward each other;

release means for releasing the pressing of said thermal heads and platen rollers by said press means; and selecting means for selecting thermal heads and platen rollers which should be released from the pressing by the release means based on a width of the recording paper.

2. The thermal printer according to claim 1, wherein said thermal printer further comprises a support for individually supporting said thermal heads and a case for housing said support, and said press means comprises a rotation shaft for rotatably supporting said support in said case and a compression spring, arranged between said support and case, for biasing said support toward said platen roller.

3. The thermal printer according to claim 2, wherein said release means comprises a solenoid having a drive shaft penetrating said case and fixed outside said case, and an engaging member for engaging a distal end of said drive shaft with said support.

4. The thermal printer according to claim 1, further comprising a cover which can be closed to cover said thermal head and opened to retact therefrom, and a plurality of mounting members hanging from said cover, said platen roller being supported by said mounting members.

5. The thermal printer according to claim 1, wherein said selecting means comprises a plurality of sensors, arranged at positions corresponding to a plurality of standardized widths of recording paper for detecting recording paper, and for causing said release means to selectively disengage the contact between said thermal head and said platen roller in a portion where the recording paper does not pass.

* * * * *